US006152529A

United States Patent [19]

Beason

[11] Patent Number: 6,152,529

[45] Date of Patent: Nov. 28, 2000

[54] MOTOR DRIVEN ROCKING CHAIR

[76] Inventor: Michael E. Beason, 22206 N. 32nd Ave., Phoenix, Ariz. 85027

[21] Appl. No.: 09/337,823

[22] Filed: Jun. 22, 1999

[51] Int. Cl.[7] ..... A47C 3/02

[52] U.S. Cl. ..... 297/260.2; 297/270.3; 297/DIG. 7

[58] Field of Search ..... 297/68, 260.1, 297/DIG. 7, 258.1, 260.2, 270.3, 270.1

[56] References Cited

U.S. PATENT DOCUMENTS

| | | | |
|---|---|---|---|
| 1,985,131 | 12/1934 | Wilke . | |
| 3,019,052 | 1/1962 | Zawadzki . | |
| 3,434,755 | 3/1969 | Caldemeyer et al. | 297/269 |
| 3,758,156 | 9/1973 | Zawadzki . | |
| 4,057,289 | 11/1977 | Jones | 297/259 |
| 4,519,647 | 5/1985 | Rogers, Jr. | 297/85 |
| 4,640,546 | 2/1987 | Aguilar | 297/260 |
| 4,707,025 | 11/1987 | Rogers, Jr. | 297/259 |
| 4,911,499 | 3/1990 | Meeker | 297/260 |

*Primary Examiner*—Milton Nelson, Jr.
*Attorney, Agent, or Firm*—Joseph N. Breaux

[57] ABSTRACT

A motor driven rocking chair that includes a seat assembly, a base assembly and a drive assembly. The seat assembly is rockably mounted onto the base assembly. The drive assembly is connected between the seat assembly and the base assembly and provides a rocking force to rock the seat assembly forward and rearward with respect to the base assembly.

1 Claim, 4 Drawing Sheets

MOTOR DRIVEN ROCKING CHAIR

TECHNICAL FIELD

The present invention relates to rocking chairs and more particularly to a motor driven rocking chair that includes a seat assembly, a base assembly and a drive assembly; the seat assembly being rockably mounted onto the base assembly; the drive assembly being connected between the seat assembly and the base assembly and providing a rocking force to rock the seat assembly forward and rearward with respect to the base assembly; the seat assembly including a recliner chair assembly mounted onto a rocking structure; the recliner chair assembly including a seat cushion and an extendable leg rest; the rocking structure including a curved base contact element rockably supported on a support plate of the base assembly seat support structure and restricted from lateral movement by a pair of restriction pins, one on either side thereof and each vertically slidably entrapped within an elongated restriction pin slide aperture formed within each of two lateral restriction stops extending upward from opposed side edges of the base assembly; the base assembly including a footed floor contact structure coupled to a seat support structure, the seat support structure including the two lateral restriction stops and a front and a back rocker stop secured, respectively, to the front and back of a support plate of the seat support structure and that are sized to restrict forward and rearward rocking of the curved base contact element of the rocking structure of the seat assembly; the drive assembly including a DC drive motor, a drive cam coupled to a shaft of a DC drive motor, an AC/DC power supply with a variable resistance speed control resistor mechanically coupled to a motor speed control lever pivotally mounted to the base assembly; a safety relay having relay contacts in series connection between a DC drive motor power input and a power output of the AC/DC power supply that are controlled by a relay control input, a seat weight sensor motor cut off switch in series connection between the DC drive motor power input and the power output of a AC/DC power supply, a safety timer having a control output, a leg rest position sensor motor cut off switch, and a spring loaded shock absorbing drive linkage including first and second slidably connected link structures each having a pivot pin connecting aperture formed through a far end thereof and a stop collar formed around the circumference thereof, and a compression spring positioned between the two stop collars in a manner to bias the first and second link structures to an elongated position; the compression spring being compressible when the far ends of the first and second slidably connected link structures are compressed toward each other to provide a shock absorbing effect between the rocking structure and the base assembly; the control output of the safety timer and the leg rest position sensor motor cutoff switch being in parallel connection with the relay control input of the safety relay such that extending the leg rest of the seat assembly and expiration of a timer period each causes the relay contacts to move to an open state; the seat weight sensor motor cut off switch being a normally open mechanical switch positioned within the seat cushion of the seat assembly and having a switch actuation weight selected such that a weight of at least fifty pounds must be placed on the seat cushion of the seat assembly before the seat weight sensor motor cut off switch closes.

BACKGROUND ART

Rocking back and forth provides a soothing effect to many individuals. Although many individuals enjoy rocking back and forth, injury or other infirmity prevents them from generating the forces necessary to rock a rocking chair back and forth. It would be desirable, therefore, to have a rocking chair that included a drive mechanism for rocking the rocking chair back and forth. In addition, because the desired rocking frequency can vary from individual to individual, it would also be desirable to have a rocking chair with a drive mechanism that included a speed control that allowed the user to select a desired rocking frequency.

GENERAL DISCUSSION OF INVENTION

It is thus an object of the invention to provide a motor driven rocking chair that includes a seat assembly, a base assembly and a drive assembly; the seat assembly being rockably mounted onto the base assembly; the drive assembly being connected between the seat assembly and the base assembly and providing a rocking force to rock the seat assembly forward and rearward with respect to the base assembly; the seat assembly including a recliner chair assembly mounted onto a rocking structure; the recliner chair assembly including a seat cushion and an extendable leg rest; the rocking structure including a curved base contact element rockably supported on a support plate of the base assembly seat support structure and restricted from lateral movement by a pair of restriction pins, one on either side thereof and each vertically slidably entrapped within an elongated restriction pin slide aperture formed within each of two lateral restriction stops extending upward from opposed side edges of the base assembly; the base assembly including a footed floor contact structure coupled to a seat support structure, the seat support structure including the two lateral restriction stops and a front and a back rocker stop secured, respectively, to the front and back of a support plate of the seat support structure and that are sized to restrict forward and rearward rocking of the curved base contact element of the rocking structure of the seat assembly; the drive assembly including a DC drive motor, a drive cam coupled to a shaft of a DC drive motor, an AC/DC power supply with a variable resistance speed control resistor mechanically coupled to a motor speed control lever pivotally mounted to the base assembly; a safety relay having relay contacts in series connection between a DC drive motor power input and a power output of the AC/DC power supply that are controlled by a relay control input, a seat weight sensor motor cut off switch in series connection between the DC drive motor power input and the power output of a AC/DC power supply, a safety timer having a control output, a leg rest position sensor motor cut off switch, and a spring loaded shock absorbing drive linkage including first and second slidably connected link structures each having a pivot pin connecting aperture formed through a far end thereof and a stop collar formed around the circumference thereof, and a compression spring positioned between the two stop collars in a manner to bias the first and second link structures to an elongated position; the compression spring being compressible when the far ends of the first and second slidably connected link structures are compressed toward each other to provide a shock absorbing effect between the rocking structure and the base assembly; the control output of the safety timer and the leg rest position sensor motor cutoff switch being in parallel connection with the relay control input of the safety relay such that extending the leg rest of the seat assembly and expiration of a timer period each causes the relay contacts to move to an open state; the seat weight sensor motor cut off switch being a normally open mechanical switch positioned within the seat cushion of the seat assembly and having a switch actuation weight selected such that a weight of at least fifty pounds must be placed on the seat cushion of the seat assembly before the seat weight sensor motor cut off switch closes.

Accordingly, a motor driven rocking chair is provided. The motor driven rocking chair includes a seat assembly, a base assembly and a drive assembly; the seat assembly being rockably mounted onto the base assembly; the drive assembly being connected between the seat assembly and the base assembly and providing a rocking force to rock the seat assembly forward and rearward with respect to the base assembly; the seat assembly including a recliner chair assembly mounted onto a rocking structure; the recliner chair assembly including a seat cushion and an extendable leg rest; the rocking structure including a curved base contact element rockably supported on a support plate of the base assembly seat support structure and restricted from lateral movement by a pair of restriction pins, one on either side thereof and each vertically slidably entrapped within an elongated restriction pin slide aperture formed within each of two lateral restriction stops extending upward from opposed side edges of the base assembly; the base assembly including a footed floor contact structure coupled to a seat support structure, the seat support structure including the two lateral restriction stops and a front and a back rocker stop secured, respectively, to the front and back of a support plate of the seat support structure and that are sized to restrict forward and rearward rocking of the curved base contact element of the rocking structure of the seat assembly; the drive assembly including a DC drive motor, a drive cam coupled to a shaft of a DC drive motor, an AC/DC power supply with a variable resistance speed control resistor mechanically coupled to a motor speed control lever pivotally mounted to the base assembly; a safety relay having relay contacts in series connection between a DC drive motor power input and a power output of the AC/DC power supply that are controlled by a relay control input, a seat weight sensor motor cut off switch in series connection between the DC drive motor power input and the power output of a AC/DC power supply, a safety timer having a control output, a leg rest position sensor motor cut off switch, and a spring loaded shock absorbing drive linkage including first and second slidably connected link structures each having a pivot pin connecting aperture formed through a far end thereof and a stop collar formed around the circumference thereof, and a compression spring positioned between the two stop collars in a manner to bias the first and second link structures to an elongated position; the compression spring being compressible when the far ends of the first and second slidably connected link structures are compressed toward each other to provide a shock absorbing effect between the rocking structure and the base assembly; the control output of the safety timer and the leg rest position sensor motor cutoff switch being in parallel connection with the relay control input of the safety relay such that extending the leg rest of the seat assembly and expiration of a timer period each causes the relay contacts to move to an open state; the seat weight sensor motor cut off switch being a normally open mechanical switch positioned within the seat cushion of the seat assembly and having a switch actuation weight selected such that a weight of at least fifty pounds must be placed on the seat cushion of the seat assembly before the seat weight sensor motor cut off switch closes.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
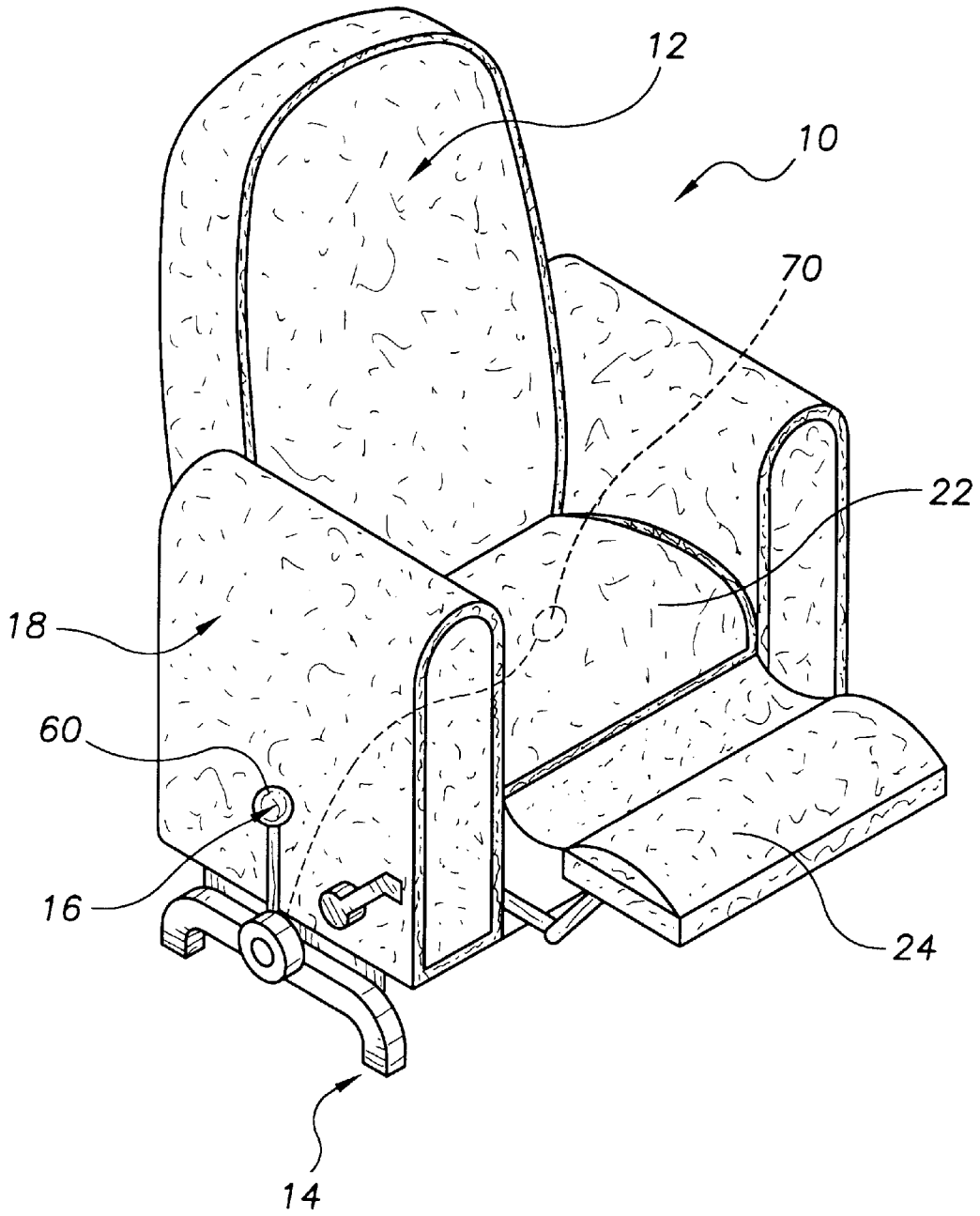
FIG. 1 is a perspective view of an exemplary embodiment of the motor driven rocking chair of the present invention showing the seat assembly rockably mounted onto the base assembly; the leg rest deployment lever; the seat weight sensor motor cut off switch; the leg rest position sensor motor cut off switch; and the motor speed control lever.

FIG. 1 shows an exemplary embodiment of the motor driven rocking chair of the present invention generally designated 10. Motor driven rocking chair 10 includes a seat assembly, generally designated 12; a base assembly, generally designated 14; and a drive mechanism, generally designated 16 (see also FIG. 2). Seat assembly 12 is rockably mounted onto base assembly 14. Drive assembly 16 is mechanically connected between seat assembly 12 and base assembly 14 and provides a rocking force to rock seat assembly 12 forward and rearward with respect to base assembly 14.

Figure 3:
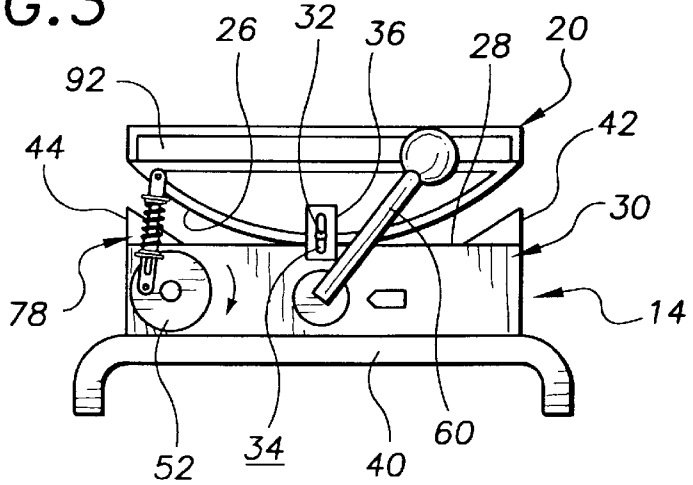
FIG. 3 is a partial plan view of the base assembly supporting the rocking structure of the seat assembly of FIG. 1 along with elements of the rocker drive assembly; the rocking structure including a curved base contact element rockably supported on a support plate of the base assembly seat support structure and restricted from lateral movement by a pair of restriction pins, one on either side thereof and each vertically slidably entrapped within an elongated restriction pin slide aperture formed within each of two lateral restriction stops extending upward from opposed side edges of the base assembly; the base assembly including a footed floor contact structure coupled to the seat support structure, the seat support structure having a front and a back rocker stop secured, respectively, to the front and back of the support plate of the base assembly and sized to restrict forward and rearward rocking of the curved base contact element of the seat assembly and the two lateral restriction stops; the drive assembly including a DC drive motor mounted to the seat support structure, the drive cam coupled to the shaft of the DC drive motor, the AC/DC power supply with the variable resistance speed control resistor mechanically coupled to a motor speed control lever pivotally mounted to the seat support structure, and the spring loaded shock absorbing drive linkage coupled between the drive cam and the back end of the rocking structure; the rocking structure of the seat assembly being positioned in this view in the first level position.
Figure 4:
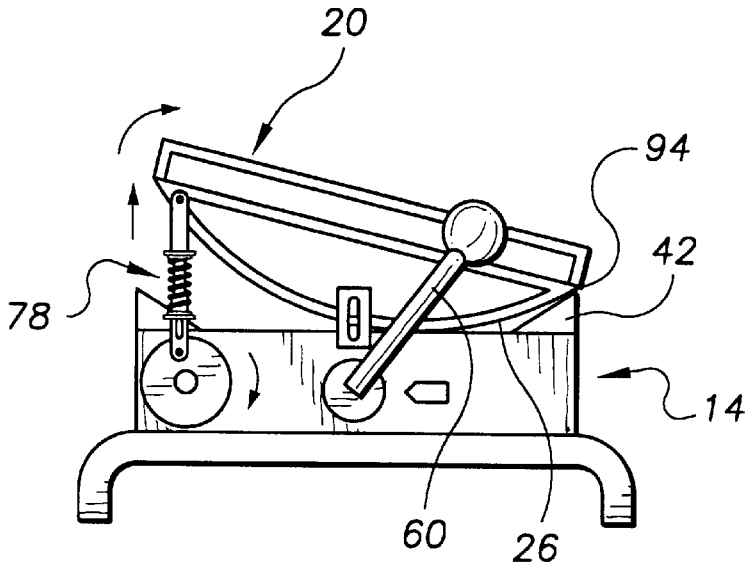
FIG. 4 is a second plan view showing the rocking structure of the seat assembly in the forward tilting position with the front end of the curved base contact element of the rocker structure in contact with the front rocker stop.
Figure 5:
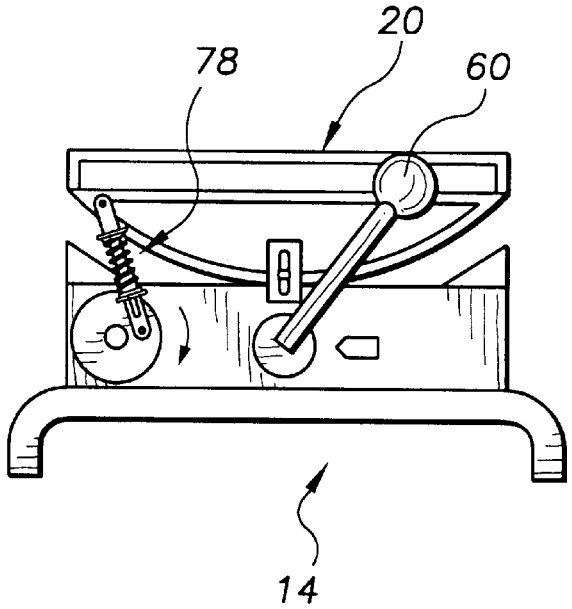
FIG. 5 is a third plan view showing the rocking structure of the seat assembly positioned in the second level position.
Figure 6:
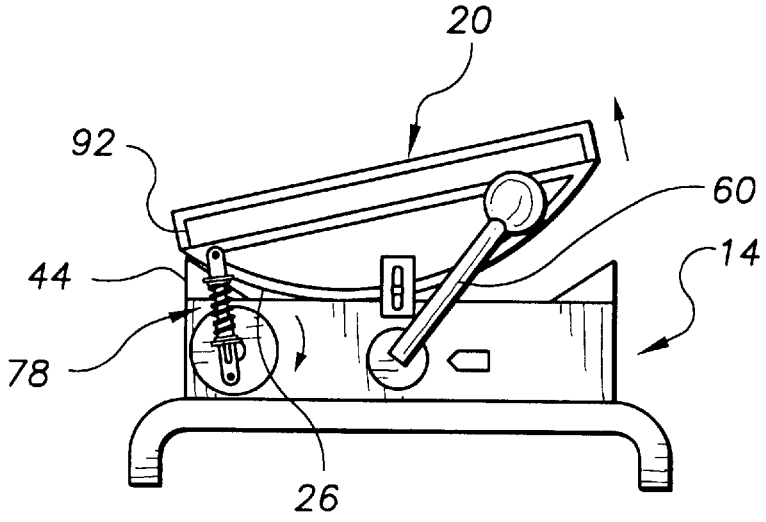
FIG. 6 is a fourth plan view showing the rocking structure of the curved base contact element of the seat assembly in the rearward tilting position with the back end of the rocker structure in contact with the back rocker stop.

Seat assembly 12 includes a recliner chair assembly, generally designated 18, mounted onto a rocking structure, generally designated 20 (FIGS. 3–6). Recliner chair assembly 18 is of conventional construction and includes a seat cushion 22 and an extendable leg rest 24. With reference to FIG. 3, rocking structure 20 includes a curved base contact element 26 rockably supported on a support plate 28 of a base assembly seat support structure, generally designated 30 and restricted from lateral movement by a pair of restriction pins 32, one on either side thereof and each vertically slidably entrapped within an elongated restriction pin slide aperture 34 formed within each of two lateral restriction stops 36 extending upward from opposed side edges of base assembly 14.

Base assembly 14 includes a footed floor contact structure 40 coupled to seat support structure 30. Seat support structure 30 includes the two lateral restriction stops 36 and a front and a back rocker stop 42,44 secured, respectively, to the front and back of support plate 28. Front and back rocker stops are sized to restrict forward and rearward rocking of curved base contact element 26 of rocking structure 20 of seat assembly 12 (FIG. 1).

Figure 2:
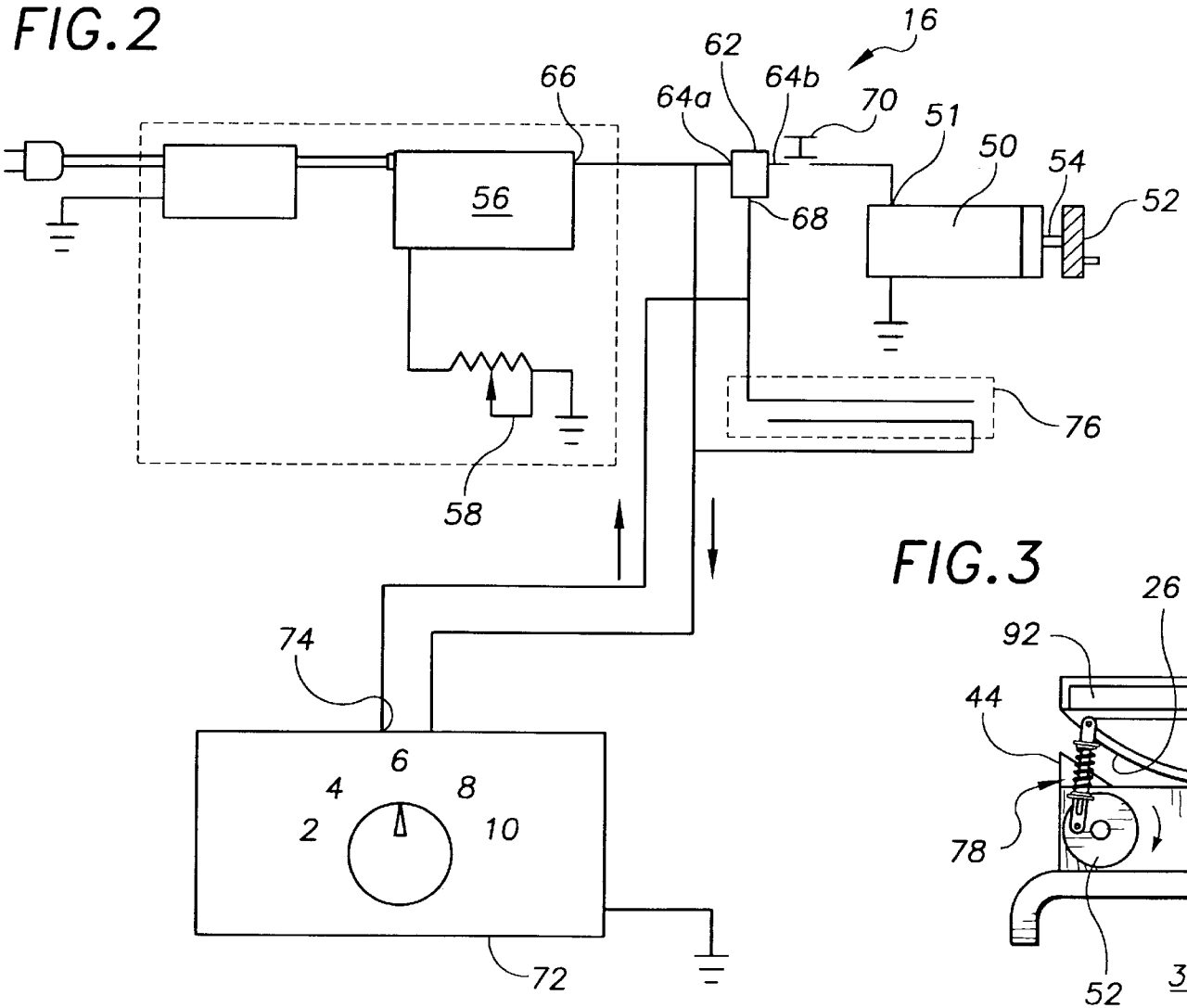
FIG. 2 is a schematic diagram of the drive assembly of the motor driven rocking chair of the present invention showing the DC drive motor, the drive cam coupled to the shaft of the DC drive motor; the AC/DC power supply with the variable resistance speed control resistor mechanically coupled to the motor speed control lever; the safety relay having relay contacts in series connection between the DC drive motor power input and the power output of the AC/DC power supply that are controlled by a relay control input; the seat weight sensor motor cut off switch in series connection between the DC drive motor power input and the power output of the AC/DC power supply; the safety timer having a control output; and a leg rest position sensor motor cut off switch; the control output of the safety timer and the leg rest position sensor motor cutoff switch being in parallel connection with the relay control input of the safety relay such that extending the leg rest and an expiration of the timer period each cause the relay contacts to move to an open state; the seat weight sensor motor cut off switch being a normally open mechanical switch positioned within the seat cushion of the seat assembly and having a switch actuation weight selected such that a weight of at least fifty pounds must be placed on the seat cushion of the seat assembly before the seat weight sensor motor cut off switch closes.
Figure 7:
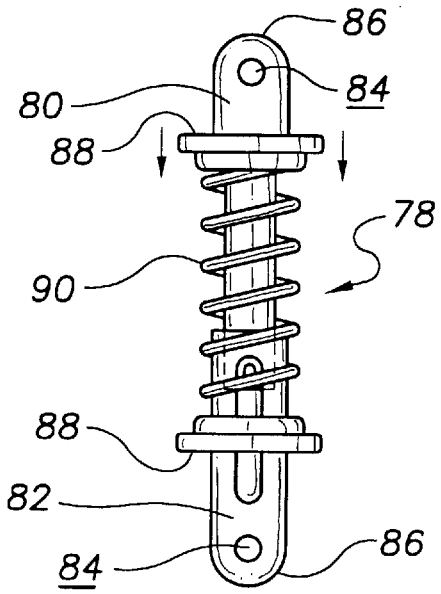
FIG. 7 is a plan view of the spring loaded shock absorbing drive linkage showing the first and second slidably connected link structures each having a pivot pin connecting aperture formed through the far ends thereof and a stop collar formed around the circumference thereof, and a compression spring positioned between the two stop collars in a manner to bias the first and second link structures to an elongated position; the compression spring being compressible when the far ends of the first and second slidably connected link structures are compressed toward each other to provide a shock absorbing effect between the rocking structure and the base assembly.

Referring now to FIG. 2, drive assembly 16 includes a DC drive motor 50 having a motor power input 51, a drive cam 52 coupled to a shaft 54 of DC drive motor 50, an AC/DC power supply 56 with a variable resistance speed control resistor 58 mechanically coupled to a motor speed control lever 60 (FIGS. 1 and 3–6) pivotally mounted to base assembly 14 (FIG. 1 and 3–6), a safety relay 62 having relay contacts 64*a*,64*b* in series connection between DC drive motor power input 51 and a power output 66 of AC/DC power supply 56 that are controlled by a relay control input 68, a seat weight sensor motor cut off switch 70 in series connection between DC drive motor power input 51 and power output 66 of AC/DC power supply 56, a safety timer 72 having a control output 74, a leg rest position sensor motor cut off switch 76, and a spring loaded shock absorbing drive linkage, generally designated 78 (FIGS. 3–7). Referring to FIG. 7, spring loaded shock absorbing drive linkage 78 includes first and second slidably connected link structures 80,82 each having a pivot pin connecting aperture 84 formed through a far end 86 thereof and a stop collar 88 formed around the circumference thereof, and a compression spring 90 positioned between the two stop collars 88 in a manner to bias far ends 86 of first and second link structures 80,82 to an elongated position and away from each other. Compression spring 90 is compressible when the far ends 86 of first and second slidably connected link structures 80,82 are compressed toward each other to provide a shock absorbing effect between, referring now to FIG. 3, rocking structure 20 and base assembly 14.

With reference to FIGS. 3–6, spring loaded shock absorbing drive linkage 78 is pivotally linked between drive cam 52 and the back end 92 of rocking structure 20. Rotation of drive cam 52 causes rocking structure to rock from a first level position shown in FIG. 1; to, with reference to FIG. 4, a forward tilting position with the front end 94 of curved base contact element 26 of rocker structure 20 in contact with front rocker stop 42; to, referring now to FIG. 5, a second level position; and then to, referring to FIG. 6, a rearward tilting position with the back end 92 of curved base contact element 26 in contact with back rocker stop 44.

Referring generally to FIGS. 1–7, rotation of drive cam 52 is started by moving motor speed control lever from the off position to a desired speed position. Seat weight sensor motor cut off switch 70 provides safety protection for small children under fifty pounds by preventing operation of drive motor 50 when small child is seated on the seat cushion 22. In addition, extending leg rest 24 also prevents or stops operation of drive motor 50.

It can be seen from the preceding description that a motor driven rocking chair has been provided that includes a seat assembly, a base assembly and a drive assembly; the seat assembly being rockably mounted onto the base assembly; the drive assembly being connected between the seat assembly and the base assembly and providing a rocking force to rock the seat assembly forward and rearward with respect to the base assembly; the seat assembly including a recliner chair assembly mounted onto a rocking structure; the recliner chair assembly including a seat cushion and an extendable leg rest; the rocking structure including a curved base contact element rockably supported on a support plate of the base assembly seat support structure and restricted from lateral movement by a pair of restriction pins, one on either side thereof and each vertically slidably entrapped within an elongated restriction pin slide aperture formed within each of two lateral restriction stops extending upward from opposed side edges of the base assembly; the base assembly including a footed floor contact structure coupled to a seat support structure, the seat support structure including the two lateral restriction stops and a front and a back rocker stop secured, respectively, to the front and back of a support plate of the seat support structure and that are sized to restrict forward and rearward rocking of the curved base contact element of the rocking structure of the seat assembly; the drive assembly including a DC drive motor, a drive cam coupled to a shaft of a DC drive motor, an AC/DC power supply with a variable resistance speed control resistor mechanically coupled to a motor speed control lever pivotally mounted to the base assembly; a safety relay having relay contacts in series connection between a DC drive motor power input and a power output of the AC/DC power supply that are controlled by a relay control input, a seat weight sensor motor cut off switch in series connection between the DC drive motor power input and the power output of a AC/DC power supply, a safety timer having a control output, a leg rest position sensor motor cut off switch, and a spring loaded shock absorbing drive linkage including first and second slidably connected link structures each having a pivot pin connecting aperture formed through a far end thereof and a stop collar formed around the circumference thereof, and a compression spring positioned between the two stop collars in a manner to bias the first and second link structures to an elongated position; the compression spring being compressible when the far ends of the first and second slidably connected link structures are compressed toward each other to provide a shock absorbing effect between the rocking structure and the base assembly; the control output of the safety timer and the leg rest position sensor motor cutoff switch being in parallel connection with the relay control input of the safety relay such that extending the leg rest of the seat assembly and expiration of a timer period each causes the relay contacts to move to an open state; the seat weight sensor motor cut off switch being a normally open mechanical switch positioned within the seat cushion of the seat assembly and having a switch actuation weight selected such that a weight of at least fifty pounds must be placed on the seat cushion of the seat assembly before the seat weight sensor motor cut off switch closes.

It is noted that the embodiment of the motor driven rocking chair described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A motor driven rocking chair comprising:

a seat assembly;

a base assembly; and a drive assembly;

said seat assembly being rockably mounted onto said base assembly;

said drive assembly being connected between said seat assembly and said base assembly and providing a rocking force to rock said seat assembly forward and rearward with respect to said base assembly;

said seat assembly including a recliner chair assembly mounted onto a rocking structure;

said recliner chair assembly including a seat cushion and an extendable leg rest;

said rocking structure including a curved base contact element rockably supported on a support plate of a base assembly seat support structure and restricted from lateral movement by a pair of restriction pins, one on either side thereof and each vertically slidably entrapped within an elongated restriction pin slide aperture formed within each of two lateral restriction stops extending upward from opposed side edges of said base assembly;

said base assembly including a footed floor contact structure coupled to said seat support structure, said seat support structure including said two lateral restriction stops and a front and a back rocker stop secured, respectively, to the front and back of said support plate of said seat support structure and that are sized to restrict forward and rearward rocking of said curved base contact element of said rocking structure of said seat assembly;

said drive assembly including a DC drive motor, a drive cam coupled to a shaft of said DC drive motor, an AC/DC power supply with a variable resistance speed control resistor mechanically coupled to a motor speed control lever pivotally mounted to said base assembly, a safety relay having relay contacts in series connection between a DC drive motor power input and a power output of said AC/DC power supply that are controlled by a relay control input, a seat weight sensor motor cut off switch in series connection between said DC drive motor power input and said power output of said AC/DC power supply, a safety timer having a control output, a leg rest position sensor motor cut off switch, and a spring loaded shock absorbing drive linkage including first and second slidably connected link structures each having a pivot pin connecting aperture formed through a far end thereof and a stop collar formed around the circumference thereof, and a compression spring positioned between said two stop collars in a manner to bias said first and second link structures to an elongated position;

said compression spring being compressible when said far ends of said first and second slidably connected link structures are compressed toward each other to provide a shock absorbing effect between said rocking structure and said base assembly;

said control output of said safety timer and said leg rest position sensor motor cutoff switch being in parallel connection with said relay control input of said safety relay such that extending said leg rest of said seat assembly and expiration of a timer period each causes said relay contacts to move to an open state;

said seat weight sensor motor cut off switch being a normally open mechanical switch positioned within said seat cushion of said seat assembly and having a switch actuation weight selected such that a weight of at least fifty pounds must be placed on said seat cushion of said seat assembly before said seat weight sensor motor cut off switch closes.

* * * * *